US009356381B2

(12) United States Patent
Yi et al.

(10) Patent No.: US 9,356,381 B2
(45) Date of Patent: May 31, 2016

(54) PROTECTIVE COVER CONFIGURED TO COVER A MATING INTERFACE OF AN ELECTRICAL CONNECTOR

(71) Applicant: Tyco Electronics Corporation, Berwyn, PA (US)

(72) Inventors: Chong Hun Yi, Mechanicsburg, PA (US); Kevin Michael Thackston, York, PA (US); Keith Miller, Manheim, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/491,516

(22) Filed: Sep. 19, 2014

(65) Prior Publication Data

US 2016/0087367 A1 Mar. 24, 2016

(51) Int. Cl.

| | |
|---|---|
| ***H01R 13/44*** | (2006.01) |
| ***H01R 13/447*** | (2006.01) |
| ***H01R 13/453*** | (2006.01) |
| ***H01R 13/52*** | (2006.01) |

(52) U.S. Cl.

CPC ..... *H01R 13/447* (2013.01); *H01R 13/4538* (2013.01); *H01R 13/5213* (2013.01)

(58) Field of Classification Search

CPC ..... H01R 13/5213; H01R 13/4534; H01R 13/44; H01R 13/4538; H01R 2201/06

USPC ..... 439/135, 136, 137, 140, 148, 149, 528

See application file for complete search history.

(56) References Cited

U.S. PATENT DOCUMENTS

| | | | | | |
|---|---|---|---|---|---|
| 3,550,062 | A * | 12/1970 | Drenten | H01R 12/714 | 361/776 |
| 4,080,031 | A * | 3/1978 | Sawford-Atkins | H05K 7/1418 | 439/377 |
| 4,396,245 | A * | 8/1983 | Lane | H01R 13/443 | 29/758 |
| 4,914,552 | A * | 4/1990 | Kecmer | H05K 7/1404 | 211/41.17 |
| 5,122,079 | A * | 6/1992 | Locati | H01R 12/675 | 439/417 |
| 5,242,311 | A * | 9/1993 | Seong | H01R 13/443 | 439/135 |
| 5,283,713 | A * | 2/1994 | Nagafuji | H01R 13/629 | 211/41.17 |
| 5,317,481 | A * | 5/1994 | Hillis | H01R 23/72 | 211/41.17 |
| 5,401,183 | A * | 3/1995 | Tan | H01R 12/7005 | 439/135 |
| 5,746,611 | A * | 5/1998 | Brown | H01R 13/5213 | 439/135 |
| 5,756,937 | A * | 5/1998 | Gleadall | H01R 13/447 | 174/138 F |

(Continued)

*Primary Examiner* — Neil Abrams
*Assistant Examiner* — Travis Chambers

(57) ABSTRACT

Protective cover including a mating cap having a cap body. The cap body includes a connector cavity that opens in a loading direction. The connector cavity is configured to receive an electrical connector of a communication system when the mating cap is moved in a loading direction onto the electrical connector. The cap body is configured to surround a mating interface of the electrical connector. The protective cover also includes a movable latch that is coupled to the mating cap and extends in a rearward direction that is generally opposite the loading direction. The movable latch has a side surface and a latch projection that extends laterally from the side surface. The movable latch is configured to flex relative to the mating cap to move the latch projection. The latch projection is configured to engage the communication system to block the protective cover from being inadvertently removed.

20 Claims, 5 Drawing Sheets

(56) References Cited

U.S. PATENT DOCUMENTS 6,056,579 A * 5/2000 Richards, III ..... H01R 12/7005 439/327
6,142,798 A * 11/2000 Tran ..... H01R 12/7011 439/135
6,176,727 B1 * 1/2001 Liu ..... H01R 12/7005 439/327
6,220,903 B1 * 4/2001 Huang ..... H01R 43/0256 29/739
6,522,554 B1 * 2/2003 Gomez ..... H05K 7/1418 361/727
6,602,096 B1 * 8/2003 Kronestedt ..... G06K 7/0021 439/188
6,629,855 B1 * 10/2003 North ..... H05K 7/1405 439/325
6,722,908 B2 * 4/2004 Llapitan ..... H01L 23/4093 257/E23.086
7,322,836 B2 * 1/2008 Shun ..... H01R 43/0263 439/135
7,775,811 B2 * 8/2010 Lai ..... H01R 13/443 439/135
2006/0134952 A1 * 6/2006 Meister ..... H01R 13/443 439/148
2007/0249194 A1 * 10/2007 Liao ..... H01R 13/5213 439/135

* cited by examiner

PROTECTIVE COVER CONFIGURED TO COVER A MATING INTERFACE OF AN ELECTRICAL CONNECTOR

BACKGROUND

The subject matter herein relates generally to communication systems having electrical connectors that interconnect communication devices.

Communication systems, such as routers, servers, switches, mass data storage systems, and the like, may be complex systems that have a number of components interconnected to one another. One particular example of a communication system that interconnects several components is referred to as VPX, which is a more recent computer bus standard that was developed for rugged applications. VPX is particularly used for aerospace and military applications. A VPX system typically includes a large printed circuit board, which may be referred to as a backplane, that interconnects a plurality of devices. The backplane may have several board connectors mounted thereto in which each board connector mates with a corresponding device, such as a daughter card assembly. The board connectors are electrically interconnected to one another through conductive traces of the backplane circuit board. The backplane circuit board interconnects the different devices through the conductive traces.

Electrical connectors, such as the board connectors described above, have mating interfaces that mate with a corresponding connector. The mating interface may include electrical contacts and surfaces of a housing of the electrical connector that engage the corresponding connector. There may be times during the operational life of the communication system in which at least one of the electrical connectors is not mated with a corresponding connector such that the mating interface of the electrical connector is exposed to the ambient environment. To reduce the likelihood of water, dust, or other debris contaminating the mating interface of the electrical connector, a protective cover or cap may be used. Protective covers, however, may inadvertently disengage with the electrical connectors during operation of the communication system thereby exposing the mating interfaces to the surrounding environment. For applications that frequently experience shock and/or vibration, the protective covers are more likely to become disengaged if mechanisms for securing the protective cover are not used.

Accordingly, a need exists for a protective cover that remains coupled to an electrical connector when the electrical connector is not in use.

BRIEF DESCRIPTION

In an embodiment, a protective cover for an electrical connector is provided. The protective cover includes a mating cap having a cap body. The cap body includes a connector cavity that opens in a loading direction. The connector cavity is configured to receive an electrical connector of a communication system when the mating cap is moved in a loading direction onto the electrical connector. The cap body is configured to surround a mating interface of the electrical connector. The protective cover also includes a movable latch that is coupled to the mating cap and extends in a rearward direction that is generally opposite the loading direction. The movable latch has a side surface and a latch projection that extends laterally from the side surface. The movable latch is configured to flex relative to the mating cap to move the latch projection. The latch projection is configured to engage the communication system to block the protective cover from being inadvertently removed from the electrical connector.

In some embodiments, the protective cover with the movable latch may also include a system grip that is coupled to the mating cap. The system grip may include a securing wall that defines a receiving cavity. The receiving cavity may open in the loading direction and be configured to receive an alignment post of the communication system. The securing wall may be configured to grip the alignment post when received in the receiving cavity.

In an embodiment, a protective cover for an electrical connector is provided that includes a mating cap having a cap body. The cap body includes a connector cavity that opens in a loading direction. The connector cavity is configured to receive an electrical connector of a communication system when the mating cap is moved in a loading direction onto the electrical connector. The cap body is configured to surround a mating interface of the electrical connector. The protective cover also includes a system grip that is coupled to the mating cap. The system grip includes a securing wall that defines a receiving cavity. The receiving cavity opens in the loading direction and is configured to receive an alignment post of the communication system. The securing wall is configured to grip the alignment post when received in the receiving cavity.

In some embodiments, the protective cover with the system grip may also include a movable latch that is coupled to the mating cap and extends in a rearward direction that is generally opposite the loading direction. The movable latch may have a side surface and a latch projection that extends laterally from the side surface. The movable latch may be configured to flex relative to the mating cap to move the latch projection. The latch projection may be configured to engage the communication system to block the protective cover from being inadvertently removed from the electrical connector.

In an embodiment, a communication system is provided that includes a circuit board having a board side and a board connector that is mounted to the board side of the circuit board. The board connector has a mating interface that includes electrical contacts. The communication system also includes a guide element mounted to the board side. The guide element projects from the board side and includes a guide channel that extends parallel to a mating axis. The communication system also includes a protective cover that is configured to be coupled to the board connector to protect the mating interface from contaminants. The protective cover includes a mating cap having a cap body. The cap body includes a connector cavity that opens in a loading direction that extends along the mating axis. The connector cavity is configured to receive the board connector when the mating cap is moved in the loading direction. The protective cover is sized and shaped to slide within the guide channel during the loading operation.

DETAILED DESCRIPTION

Figure 1:
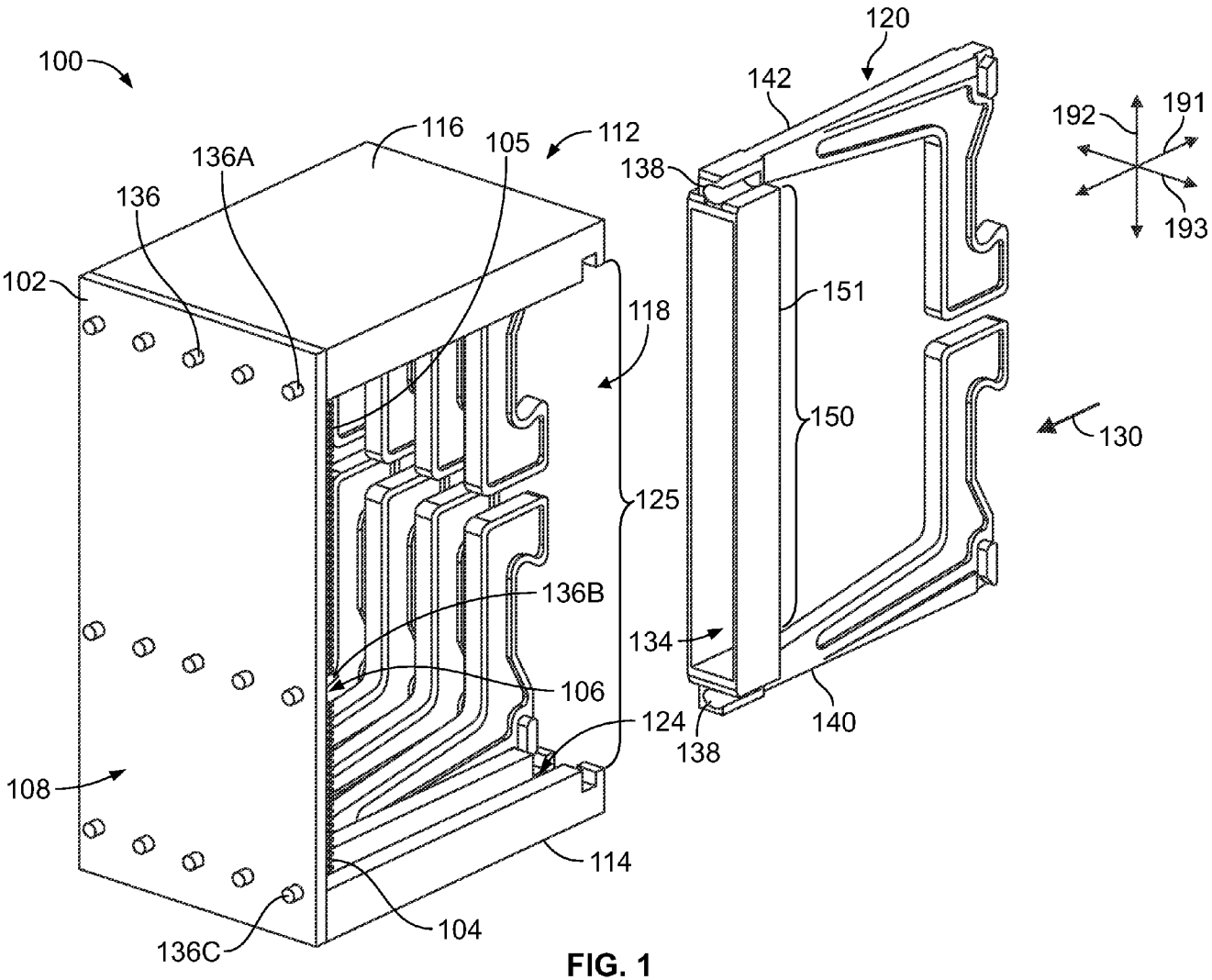
FIG. 1 is a perspective view of a communication system formed in accordance with an embodiment that includes a protective cover.

FIG. 1 is a perspective view of a portion of a communication system 100 in accordance with an embodiment. The communication system 100 includes a circuit board 102 and a plurality of electrical connectors 104, 105 mounted thereto. The circuit board 102 includes a first board side 106 and an opposite second board side 108. The electrical connectors 104, 105 are mounted to the first board side 106 of the circuit board 102. For reference, the communication system 100 is oriented with respect to mutually perpendicular axes 191-193, including a mating axis 191, a first lateral axis 192, and a second lateral axis 193. The first and second lateral axes 192, 193 extend parallel to the circuit board 102. The mating axis 191 extends orthogonal to the circuit board 102.

Although not shown, the circuit board 102 includes a plurality of conductive traces and vias, such as plated thru-holes, that are configured to electrically interconnect different electrical connectors 104, 105. In some embodiments, other electrical connectors (not shown) may be mounted to the second board side 108 and electrically connected to the electrical connectors 104, 105 through the conductive traces and plated thru-holes. In some embodiments, the communication system 100 only includes the electrical connectors 104, 105 along the first board side 106.

In particular embodiments, the circuit board 102 may be a backplane circuit board and the communication system 100 may be a backplane communication system. The communication system 100 may interconnect a plurality of devices, such as a plurality daughter card assemblies (not shown). The communication system 100 may be used in various applications. By way of example only, the communication system 100 may be used in telecom and computer applications, routers, servers, supercomputers, and uninterruptible power supply (UPS) systems. In some embodiments, the communication system 100 is similar to the MULTIGIG RT backplane connector system developed by TE Connectivity. The communication system 100 may be configured to satisfy various industry standards, such as VITA, VPX, and the like. In particular embodiments, the communication system 100 is configured to maintain communicative pathways through periods of shock and vibration, such as those that may occur in aerospace and military applications.

Also shown in FIG. 1, the communication system 100 includes an alignment assembly 112 that includes guide elements 114, 116. The guide elements 114, 116 are spaced apart from each other with a receiving space 118 therebetween. The guide elements 114, 116 project from the first board side 106 and include respective guide channels 124. Each guide channel 124 of the guide element 114 opposes a corresponding guide channel 124 of the guide element 116 and extends parallel to the mating axis 191. Collectively, each pair of opposing guide channels 124 and a portion of the receiving space 118 that extends between the corresponding pair of opposing guide channels 124 define a card slot 125 that is configured to receive a corresponding daughter card assembly (not shown). In FIG. 1, the alignment assembly 112 defines five (5) card slots 125. The alignment assembly 112, however, may define more or fewer card slots 125 in alternative embodiments. Each card slot 125 is aligned with a corresponding pair of board connectors 104, 105 that mate with the daughter card assembly received by the corresponding card slot 125.

Each pair of opposing guide channels 124 is configured to direct a common daughter card assembly to the corresponding board connectors 104, 105 that are aligned with the card slot 125. For example, each of the guide channels 124 is sized and shaped to receive a corresponding edge (not shown) of a daughter card (not shown) of the common daughter card assembly. The daughter card assembly may include one or more card connectors (not shown) that are mounted to a leading edge of the daughter card and mate with the corresponding board connectors 104, 105. During a loading operation, the daughter card assembly is inserted into the card slot 125 in a loading direction 130 that extends parallel to the mating axis 191. Each of the opposing guide channels 124 receives the corresponding edge of the daughter card. Surfaces of the guide elements 114, 116 that define the opposing guide channels 124 cooperate in directing the daughter card assembly to mate with the board connectors 104, 105 during the loading operation.

In other embodiments, the alignment assembly 112 may include only one of the guide elements 114, 116. For example, the alignment assembly 112 may include only the guide element 114. During the loading operation, the corresponding edge of the daughter card may slide within the guide channel 124. Surfaces that define the guide channel 124 of the guide element 114 may direct the daughter card assembly. As such, the guide element 114 alone may direct the daughter card assembly to mate with the corresponding board connectors 104, 105.

The communication system 100 may also include alignment posts 136 that are secured to the circuit board 102. The alignment posts 136 are configured to engage corresponding daughter card assemblies to align the daughter card assembly relative to the corresponding board connectors 104, 105. As shown, a plurality of alignment posts 136A-136B are coplanar and configured to engage a common daughter card assembly. The alignment posts 136A-136B extend into a common card slot 125. More specifically, the alignment post 136C extends through the circuit board 102 and clears the first board side 106 to extend into the guide channel 124 of the guide element 114. The alignment post 136B is disposed between the alignment posts 136A, 136C and between the board connectors 104, 105 along the first board side 106. Although not shown in FIG. 1, the alignment post 136A may clear the first board side 106 and extend into the guide channel 124 of the guide element 116.

When the board connectors 104, 105 are not mated with the corresponding daughter card assemblies (or other devices), the communication system 100 may utilize protective covers or caps 120. The protective covers 120 are configured to protect mating interfaces of the board connectors 104, 105. FIG. 1 illustrates five protective covers 120, but more or fewer protective covers 120 may be used depending upon the circumstances. For example, if three of the five pairs of board connectors 104, 105 were mated with corresponding daughter card assemblies, then the remaining two pairs of board connectors 104, 105 may be mated with a corresponding protective cover 120. The protective cover 120 is configured to slide within the guide channels 124 during the loading operation.

As shown, the protective cover 120 includes a mating cap 150 having a cap body 151. The cap body includes a connector cavity 134 that opens in the loading direction 130 and is sized and shaped to receive a corresponding pair of the board connectors 104, 105. The cap body 151 is an elongated body in the illustrated embodiment that extends lengthwise along the first lateral axis 192. Optionally, the protective cover 120 may also include system grips 138 that are coupled to the mating cap 150. The system grips 138 are configured to frictionally engage corresponding alignment posts 136 such that the alignment posts 136 and corresponding system grips 138 form interference fits. As such, the protective cover 120 may be secured to the board connectors 104, 105 through the interference fits. Alternatively or in addition to the system grips 138, the protective cover 120 may include movable latches 140, 142 that engage the guide elements 114, 116, respectively, to secure the protective cover 120 to the board connectors 104, 105. Regardless of the mechanism(s), with the protective cover 120 secured to the board connectors 104, 105, the protective cover 120 may protect the mating interface of the board connectors 104, 105 from contaminants even during episodes of shock and/or vibration. When it is desired to mate the board connectors 104, 105 with an electrical device, such as a daughter card assembly, the protective cover 120 may be withdrawn.

Figure 2:
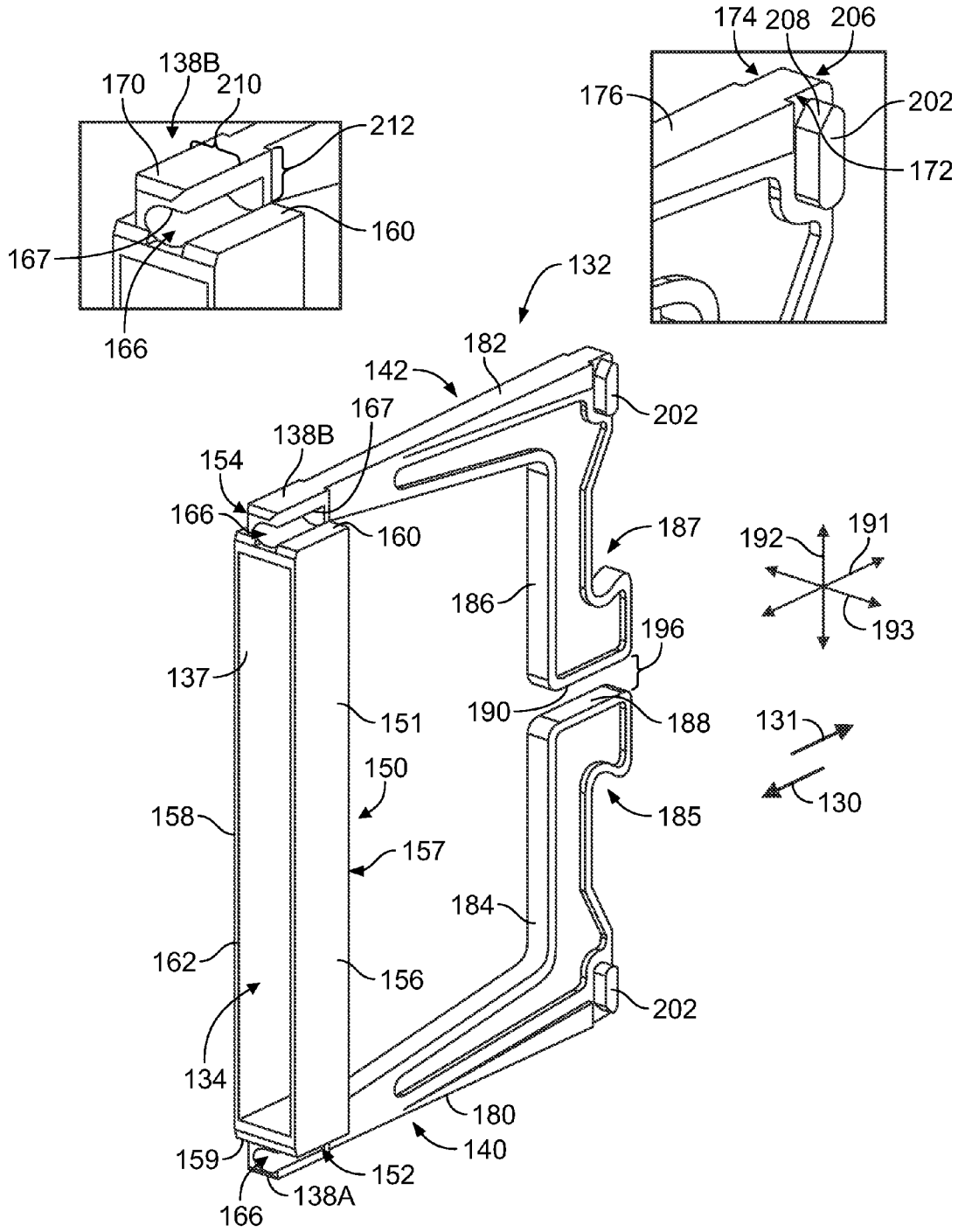
FIG. 2 is a perspective view of an exemplary protective cover formed in accordance with an embodiment that may be used with the communication system of FIG. 1.

FIG. 2 is an enlarged perspective view of an exemplary protective cover 120 formed in accordance with an embodiment. The cap body 151 of the mating cap 150 includes the connector cavity 134, which opens in the loading direction 130 and is configured to receive the board connectors 104, 105 during the loading operation. The cap body 151 is sized and shaped to surround mating interfaces of the board connectors 104, 105. In other embodiments, the connector cavity 134 may be sized and shaped to receive only one of the board connectors. The cap body 151 extends betweens and joins the movable latches 140, 142.

In some embodiments, the protective cover 120 is a single, continuous element. For example, the protective cover 120 may be molded from a plastic material to include each of the features of the protective cover 120 described herein. In other embodiments, the protective cover 120 may include multiple components that are coupled to one another to form the protective cover 120. For example, one or more of the movable latches 140, 142 may be separately coupled to the mating cap 150.

The cap body 151 extends laterally along the first lateral axis 192 between first and second cap ends 152, 154. As shown, the mating cap 150 may be defined by cap walls 156, 157, 158, 159, 160. The cap walls 156, 158 are side walls, and the cap wall 157 is a back wall that faces rearward away from the circuit board 102 (FIG. 1) along the mating axis 191. The cap wall 157 extends between and joins the cap walls 156, 158. The cap walls 159, 160 are end walls that are located proximate to the cap ends 152, 154, respectively. The end walls 159, 160 may at least partially define the cap ends 152, 154, respectively. Collectively, the cap walls 156-160 define a receiving edge 162 of the mating cap 150 (or cap body 151) that defines an opening to the connector cavity 134. Optionally, the receiving edge 162 may be chamfered to facilitate aligning the protective cover 120 during the loading operation. More specifically, the receiving edge 162 may engage the board connectors 104, 105 during the loading operation and direct or adjust the mating cap 150 to align the connector cavity 134 with the board connectors 104, 105. The connector cavity 134 may be defined by interior surfaces 137 of one or more of the cap walls 156-160. The interior surfaces 137 may frictionally engage corresponding surfaces of the board connectors 104, 105.

The protective cover 120 also includes system grips 138A, 138B. The system grips 138A, 138B may be coupled to the mating cap 150. In the illustrated embodiment, the system grip 138A extends laterally away from the first cap end 152 of the cap body 151, and the system grip 138B extends laterally away from the second cap end 154 of the cap body 151. The system grips 138A, 138B are configured to engage a portion of the communication system 100 (FIG. 1). In an exemplary embodiment, the system grips 138A, 138B engage corresponding alignment posts 136 (FIG. 1). Each of the system grips 138A, 138B includes a receiving cavity 166 that is sized and shaped to receive a corresponding alignment post 136 (FIG. 1). The receiving cavities 166 open in the loading direction 130 and are defined by respective surfaces 167 of the protective cover 120. During the loading operation, the alignment posts 136 advance into the corresponding receiving cavities 166 and engage the surfaces 167.

FIG. 2 includes an enlarged view of the system grip 138B. Although the following is with reference to the system grip 138B, the description may also be applied to the system grip 138A. The receiving cavity 166 is defined by a securing wall 170 of the system grip 138B. The securing wall 170 includes the surfaces 167 that frictionally engage the alignment posts 136 (FIG. 1). The securing wall 170 extends away from the end wall 160 along the first lateral axis 192 and then along the second lateral axis 193 to define the receiving cavity 166. In FIG. 2, the securing wall 170 is a single contoured wall that extends around the receiving cavity 166, the securing wall 170 may be multiple walls in other embodiments that grip the alignment post 136.

The securing wall 170 is configured to grip a corresponding alignment post 136. The securing wall 170 may be configured to flex, stretch, or otherwise adjust so that the receiving cavity 166 may receive the alignment post 136. In an exemplary embodiment, the receiving cavity 166 is an open-sided cavity that opens longitudinally along the mating axis 191. The open-sided cavity may permit the securing wall 170 to stretch or expand for receiving the alignment post 136. The receiving cavity 166 is sized and shaped relative to the alignment post 136 such that the corresponding surface 167 frictionally engages (i.e., grips) the alignment post 136. In some embodiments, the securing wall 170 may be permitted to flex (e.g., stretch or expand) for the alignment post 136.

The combined frictional forces generated by the system grips 138A, 138B with respect to the alignment posts 136 may secure the protective cover 120 to the board connectors 104, 105. In some embodiments, the frictional forces generated by the system grips 138A, 138B with respect to the alignment posts 136 and the frictional forces generated by the cap body 151 with respect to the board connectors 104, 105 may combine to secure the protective cover 120 to the board connectors 104, 105.

The system grips 138A, 138B are sized and shaped relative to the guide channels 124 (FIG. 1) so that the system grips 138A, 138B may slide therethrough during the loading operation. The system grips 138A, 138B include a grip width 210 that is measured along the second lateral axis 193, and a grip height 212 that is measured along the first lateral axis 192. The grip height 212 is measured from the end wall 160. In some embodiments, the end wall 160 is configured to slidably engage the guide element 116 (FIG. 1) of the alignment assembly 112 (FIG. 1).

Optionally, the movable latches 140, 142 may facilitate securing the protective cover 120 to the board connectors 104, 105. The movable latches 140, 142 are coupled to the mating cap 150 (or the cap body 151) and extend in a rearward direction 131 that is generally opposite the loading direction 130. The loading and rearward directions 130, 131 extend orthogonal to the first and second lateral axes 192, 193. In some embodiments, the movable latches 140, 142 are coupled proximate to the first and second cap ends 152, 154, respectively. In particular embodiments, the movable latches 140, 142 may be directly coupled to the system grips 138A, 138B, respectively.

The movable latches 140, 142 include respective latch segments 180, 182 that project from the system grips 138A, 138B. The latch segments 180, 182 may extend generally parallel to the mating axis 191 and are configured to flex or pivot with respect to the mating cap 150 or the respective system grips 138A, 138B. The latch segments 180, 182 may be positioned within corresponding guide channels 124 when the protective cover 120 is in a loaded position. The movable latches 140, 142 also include operator-engaging segments 184, 186, respectively, that are joined to the latch segments 180, 182, respectively. The operator-engaging segments 184, 186 are configured to be engaged by an operator. For example, the operator-engaging segments 184, 186 include recesses 185, 187, respectively, that are sized and shaped to receive fingers of the operator, which may be an individual or machine. The operator-engaging segments 184, 186 also include distal ends 188, 190, respectively. The distal ends 188, 190 are distal edges of the movable latches 140, 142 in the illustrated embodiment. The distal ends 188, 190 face each other with an operative space or gap 196 therebetween. The operative space 196 allows the movable latches 140, 142 to be flexed toward each other during, for example, the loading operation. For example, the operator may press the movable latches 140, 142 toward each and/or the movable latches 140, 142 may be deflected toward each other during the loading operation.

The movable latches 140, 142 may enable an operator to hold the protective cover 120 and insert the protective cover 120 within a corresponding card slot 125 (FIG. 1) such that the mating cap 150 mates with and covers the board connectors 104, 105. In some embodiments, the movable latches 140, 142 may also facilitate securing the protective cover 120 to the circuit board 102. For example, one or more of the movable latches 140, 142 may include one or more latch projections 202.

An exemplary latch projection 202 is shown in an enlarged view in FIG. 2 with respect to the movable latch 142. The movable latch 142 has opposite side surfaces 172, 174 and an outer edge 176 that extends between the opposite side surfaces 172, 174. The movable latch 142 may include a latch projection 202 along the side surface 172, and a latch projection 202 (not shown) along the side surface 174. The latch projections 202 extend laterally from the corresponding side surfaces 172, 174. More specifically, the latch projections 202 project along the second lateral axis 193. The latch projections 202 are sized and shaped relative to the guide element 116 (FIG. 1) to engage the guide element 116. The movable latch 142 is configured to flex relative to the mating cap 150 to move the latch projections 202 for engaging the guide element 116.

The latch projection 202 is located proximate to an outer edge 176 of the movable latch 142. In the illustrated embodiment, the latch projection 202 is located proximate to an elbow 206 that joins the latch segment 182 and the operator-engaging segment 186 of the movable latch 142. As described below, the latch projection 202 is configured to function as a positive stop that prevents the protective cover 120 from inadvertently moving away from the circuit board 102 (FIG. 1). As shown, the latch projection 202 includes a leading surface 208. The leading surface 208 may be configured to engage the corresponding guide element 116 during the loading operation.

Figure 3:
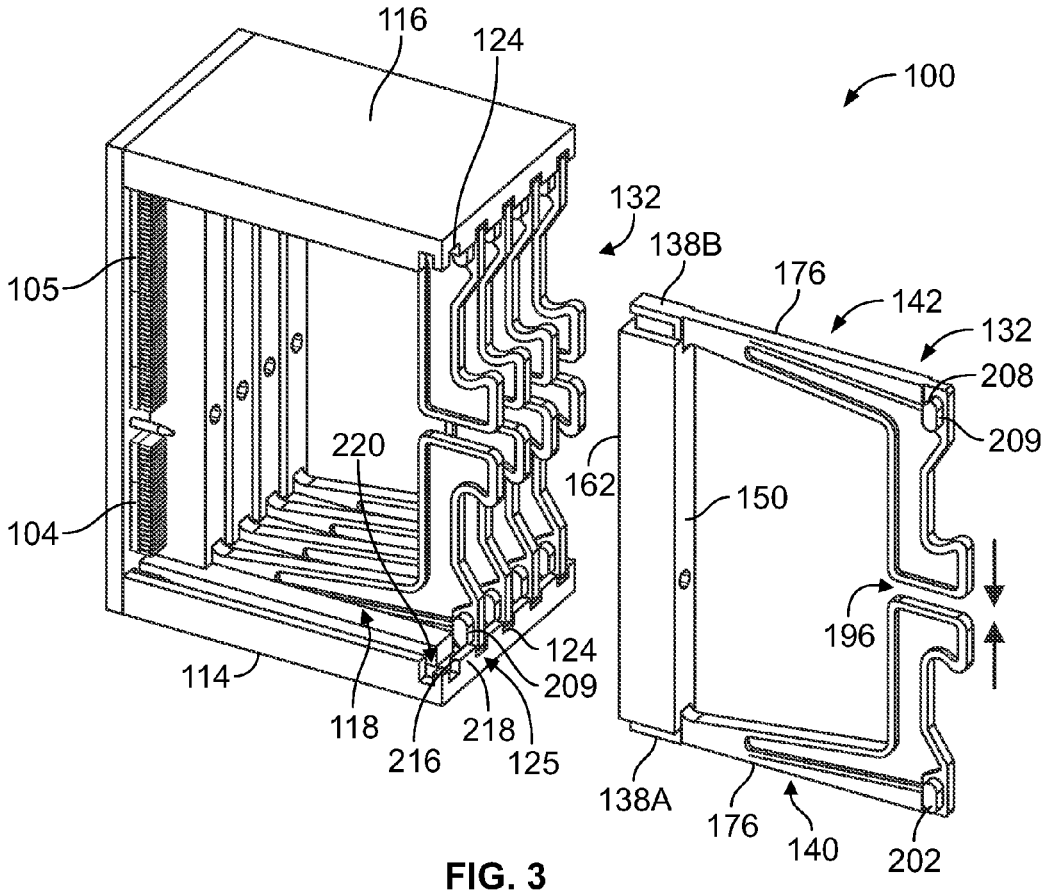
FIG. 3 is a perspective view of the communication system of FIG. 1 having the protective cover poised for loading.
Figure 4:
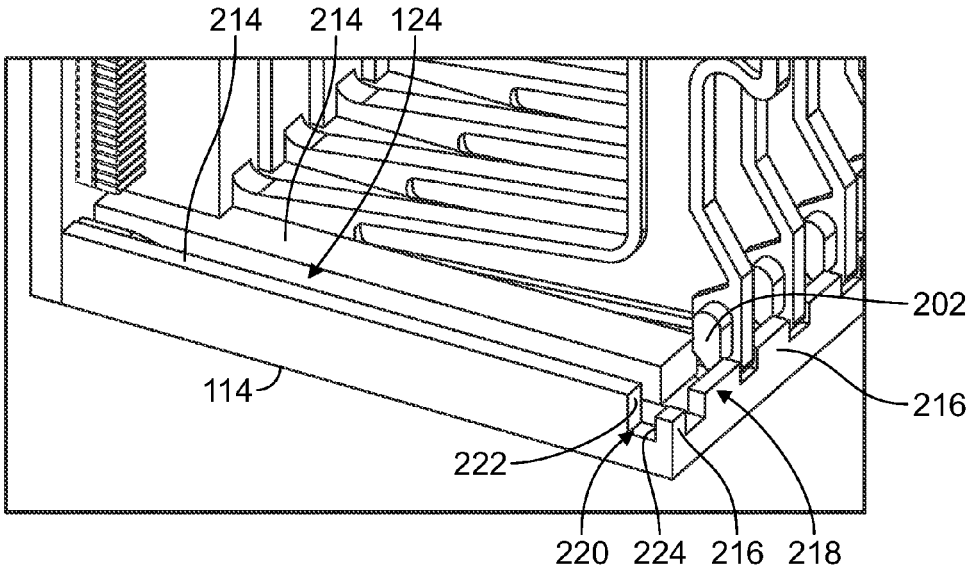
FIG. 4 is an enlarged view of the communication system shown in FIG. 3.

FIG. 3 illustrates an enlarged perspective view of the communication system 100 in which four of the protective covers 120 are in loaded positions and another of the protective covers 120 is poised for insertion into a corresponding card slot 125. FIG. 4 illustrates an enlarged view of FIG. 3. With respect to FIG. 4, the guide channels 124 of the guide element 114 extend parallel to each other. Each of the guide channels 124 is defined between a pair of guide tracks 214.

Also shown in FIG. 4, the guide element 114 may include a plurality of cover deflectors 216. The cover deflectors 216 are walls or blocks of the guide element 114 that are aligned with corresponding guide tracks 214. The cover deflectors 216 may define openings to the guide channels 124. The cover deflectors 216 include respective front faces 218 that face an exterior of the alignment assembly 112 (FIG. 3). The guide element 114 also includes channel recesses or notches 220. Each of the channel recesses 220 is defined between a first recess surface 222 of a corresponding guide track 214 and a second recess surface 224 of a corresponding cover deflector 216. The first and second recess surfaces 222, 224 oppose each other with a corresponding channel recess 220 therebetween. As shown in FIG. 4, the channel recesses 220 are sized and shaped to receive corresponding latch projections 202.

With respect to FIG. 3, the system grips 138A, 138B may align with and advance through the corresponding guide channels 124 of the guide elements 114, 116, respectively, during the loading operation. During the loading operation, the movable latches 140, 142 may be pressed toward each other (as indicated by the arrows in FIG. 3) by the operator such that the operative gap 196 is closed. As the receiving edge 162 approaches and/or receives the board connectors 104, 105, the latch projections 202 may also advance into the receiving space 118. If the protective cover 120 is misaligned and/or if the movable latches 140, 142 are not closed, one or more of the latch projections 202 may engage the front faces 218 of the cover deflectors 216. More specifically, the leading surface 208 of the latch projection 202 may engage the front face 218 of the corresponding cover deflector 216. The cover deflector 216 may deflect the latch projection 202 and the corresponding protective cover 120. The receiving edge 162 and the latch projections 202 may cooperate to re-direct the protective cover 120 to align with the card slot 125 so that the protective cover 120 may freely advance into the card slot 125.

After the mating cap 150 has mated with the board connectors 104, 105 such that the board connectors 104, 105 have been received within the connector cavity 134 (FIG. 1), the movable latches 140, 142 may be permitted to flex or spring away from each other. At this time, the latch projections 202 may move into the corresponding channel recesses 220. The other protective covers 120 are in loaded positions in FIG. 3. In the loaded position, the blocking surface 209 of the latch projections 202 may prevent the protective covers 120 from being inadvertently removed and withdrawn from the corresponding card slot 125. More specifically, the blocking surface 209 may face and/or engage the recess surface 224 to maintain the engagement between the mating cap 150 and the board connectors 104, 105 so that the board connectors 104, 105 remain covered until it is desired to remove the protective covers 120. To remove the protective covers 120, the movable latches 140, 142 may be pressed toward each other such that the latch projections 202 clear the cover deflectors 216 and the protective cover 120 may be withdrawn by the operator from the card slot 125.

In some embodiments, the protective cover 120 has a card-like profile that is similar to a profile of the daughter card assembly (not shown). In such instances, the protective cover 120 may engage similar surfaces that the daughter card assembly would engage if inserted into the card slot 125. For example, as shown in FIG. 3, the movable latches 140, 142 include the outer edges 176. The outer edges 176 of the movable latches 140, 142 partially define a perimeter of the protective cover 120. The outer edges 176 may be similar in position and shape as side edges of the daughter card assembly. The receiving edge 162 of the mating cap 150 may have a similar position and shape as a leading end of the daughter card assembly. Accordingly, the outer edges 176 and the mating cap 150 form a card-like profile.

Figure 5:
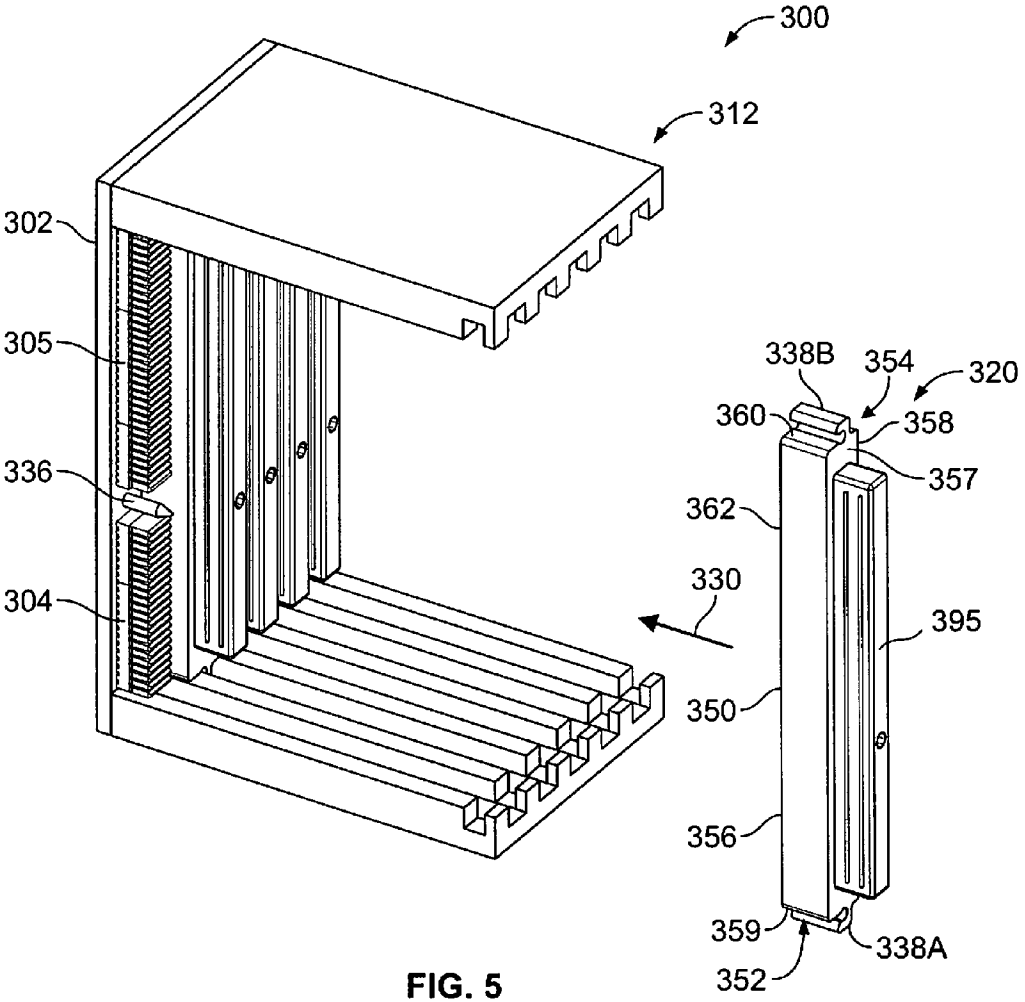
FIG. 5 is a perspective view of a communication system formed in accordance with an embodiment that includes a protective cover.

FIG. 5 is a perspective view of a communication system 300 formed in accordance with an embodiment. The communication system 300 includes a circuit board 302, electrical connectors 304, 305, and an alignment assembly 312, which may be similar or identical to the circuit board 102, the electrical connectors 104, 105, and the alignment assembly 112, respectively, of FIG. 1. As shown, the communication system 300 also includes a plurality of protective covers 320. Like the protective cover 120 (FIG. 1), the protective covers 120 are configured to cover corresponding pairs of the electrical connectors 304, 305 when the electrical connectors 304, 305 are not mated with corresponding daughter card assemblies (not shown).

The protective cover 320 includes a mating cap 350 having a cap body 351. The cap body 351 extends lengthwise between first and second cap ends 352, 354 and has a connector cavity (not shown), which is sized and shaped to receive a pair of the board connectors 304, 305. The connector cavity may be identical to the connector cavity 134 (FIG. 1). As shown, the mating cap 350 may be defined by cap walls 356, 357, 358, 359, 360. The cap walls 356, 358 are side walls, and the cap wall 357 is a back wall that faces rearward away from the circuit board 302. The cap wall 357 extends between and joins the cap walls 356, 358. The cap walls 359, 360 are end walls that are located proximate to the cap ends 352, 354, respectively. Collectively, the cap walls 356-360 define a receiving edge 362 of the mating cap 350 that defines an opening to the connector cavity.

The mating cap 350 also includes system grips 338A, 338B, which may be similar or identical to the system grips 138A, 138B of FIG. 1. In the illustrated embodiment, the system grip 338A extends laterally from the first cap end 352, and the system grip 338B extends laterally from the second cap end 354. The system grips 338A, 338B are configured to engage alignment posts 336 of the communication system 300. The alignment posts 336 are secured to the circuit board 302. Also shown in FIG. 5, the protective cover 320 may include a operator-engaging tab 395. The operator-engaging tab 395 extends rearwardly from the cap wall 357. The operator-engaging tab 395 is sized and shaped to be gripped by an individual for inserting the protective cover 320 into the alignment assembly 312.

Figure 6:
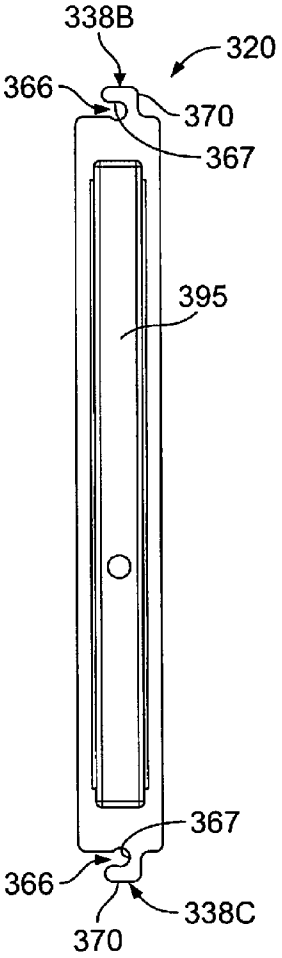
FIG. 6 is a back end view of the protective cover of FIG. 5.

FIG. 6 is a back end view of the protective cover 320. Each of the system grips 338A, 338B includes a securing wall 370 that defines an open-sided receiving cavity 366 that is sized and shaped to receive a corresponding alignment post 336 (FIG. 5). The receiving cavities 366 open in a loading direction 330 (FIG. 5) and are defined by respective surfaces 367 of the protective cover 320. During the loading operation, the alignment posts 336 advance into the corresponding receiving cavities 366 and engage the surfaces 367. The securing walls 370 are configured to grip the corresponding alignment posts 336 as described above with respect to the securing walls 170 (FIG. 2).

Figure 7:
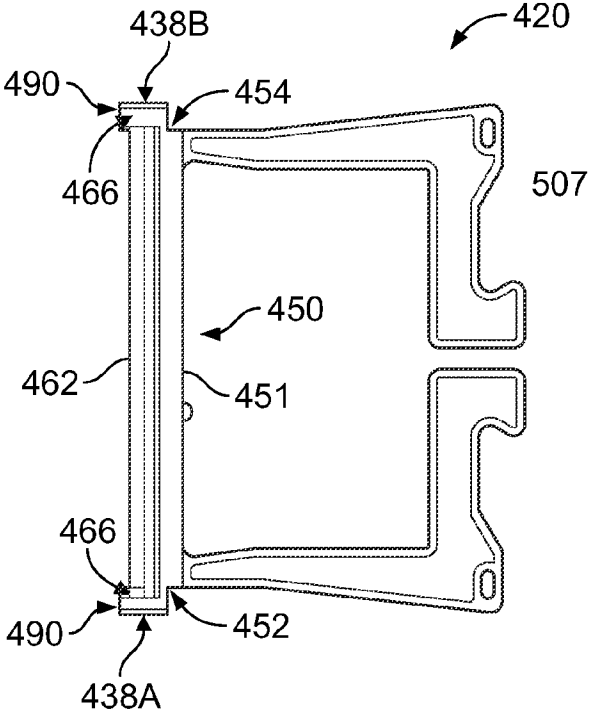
FIG. 7 illustrates a side profile of a protective cover formed in accordance with an embodiment.

FIG. 7 illustrates a side profile of a protective cover 420 formed in accordance with an embodiment. The protective cover 420 may be used with either the communication system 100 (FIG. 1) or the communication system 300 (FIG. 5). The protective cover 420 may have similar features as the protective cover 120 (FIG. 1) and the protective cover 320 (FIG. 5). For example, the protective cover 420 includes a mating cap 450 having a cap body 451. The cap body 451 extends lengthwise between first and second cap ends 452, 454 and has a connector cavity (not shown), which is sized and shaped to receive a pair of the board connectors (not shown). The connector cavity may be identical to the connector cavity 134 (FIG. 1).

The mating cap 450 also includes system grips 438A, 438B, which may be similar or identical to the system grips 138A, 138B of FIG. 1. The system grip 438A extends laterally from the first cap end 452, and the system grip 438B extends laterally from the second cap end 454. The system grips 438A, 438B are configured to engage alignment posts (not shown) of a communication system (not shown). The system grips 438A, 438B include leading ends 490 that have openings to respective receiving cavities 466 that are configured to receive the alignment posts. As shown, the leading end 490 of each of the system grips 438A, 438B clears the mating cap 450 such that the leading end 490 is located in front of the mating cap 450 during the loading operation. More specifically, the leading ends 490 of the system grips 438A, 438B may clear a receiving edge 462 of the mating cap 450.

Figure 8:
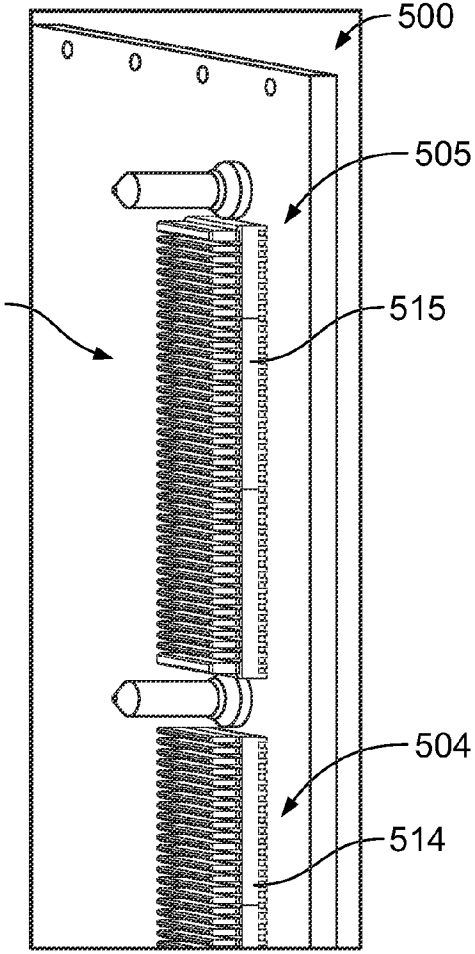
FIG. 8 is a perspective view of a circuit board and board connectors mounted to the circuit board that may be used with one or more embodiments.

FIG. 8 is a perspective view of a communication system 500 in which an alignment assembly has been removed to more clearly show mating interfaces 507 of board connectors 504, 505. The alignment assembly may be similar or identical to the alignment assembly 112. The board connectors 504, 505 may be similar or identical to the board connectors 104, 105 of FIG. 1. The board connectors 504, 504 include connector housings 514, 515. The mating interfaces 507 include electrical contacts 520 (shown in FIG. 9) and surfaces of the connector housings 514, 515 that are configured to engage a daughter card assembly (not shown) and/or a protective cover (not show).

Figure 9:
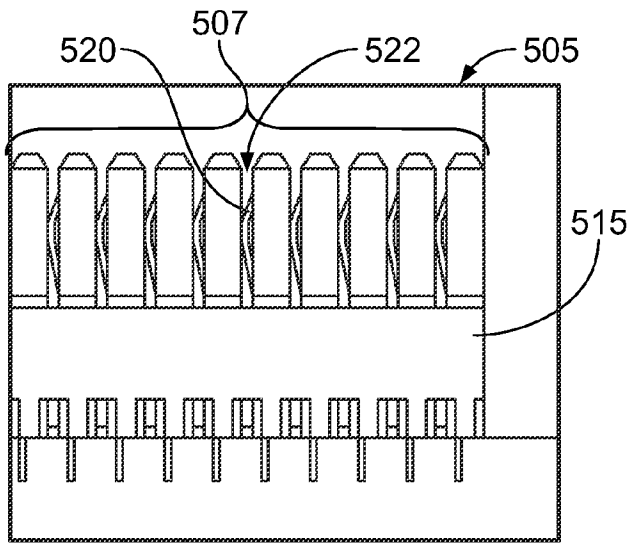
FIG. 9 is an enlarged side view of one of the board connectors of FIG. 8.

FIG. 9 is an enlarged side view of one of the electrical connectors 505. As shown, the connector housing 515 defines housing slots 522. The electrical contacts 520 are disposed within the housing slots 522 and configured to engage corresponding contacts (not shown) of the daughter card assembly. Although the mating interfaces 507 are described as having electrical contacts 520 that are disposed within slots 522, it should be understood that other configurations of mating faces may be used by embodiments set forth herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A protective cover for an electrical connector comprising:

a mating cap having a cap body, the cap body including a connector cavity that opens in a loading direction, the connector cavity configured to receive an electrical connector of a communication system when the mating cap is moved in a loading direction onto the electrical connector, the cap body configured to surround a mating interface of the electrical connector; and a movable latch coupled to the mating cap and extending in a rearward direction that is generally opposite the loading direction, the movable latch having a side surface and a latch projection that extends laterally from the side surface, the movable latch configured to flex relative to the mating cap to move the latch projection, wherein the latch projection is configured to engage the communication system to block the protective cover from being inadvertently removed from the electrical connector.

2. The protective cover of claim 1, further comprising a system grip that is coupled to the mating cap, the system grip including a securing wall that defines a receiving cavity, the receiving cavity opening in the loading direction and configured to receive an alignment post of the communication system, the securing wall configured to grip the alignment post when received in the receiving cavity.

3. The protective cover of claim 2, wherein the receiving cavity is an open-sided cavity that permits the securing wall to stretch or expand for receiving the alignment post of the communication system.

4. The protective cover of claim 2, wherein the system grip includes a leading end that clears the mating cap such that the leading end is located in front of the mating cap during the loading operation.

5. The protective cover of claim 2, wherein the cap body extends lengthwise along a lateral axis between opposite cap ends, the system grip extending laterally away from one of the cap ends.

6. The protective cover of claim 1, wherein the cap body extends lengthwise along a lateral axis between opposite first and second cap ends, the lateral axis extending orthogonal to the loading and rearward directions.

7. The protective cover of claim 6, wherein the movable latch is a first movable latch and the protective cover includes a second movable latch, the first and second movable latches being coupled proximate to the first and second cap ends, respectively, the first and second movable latches having an operative gap therebetween and being configured to flex toward one another.

8. The protective cover of claim 7, wherein the first and second movable latches include outer edges that partially define a perimeter of the protective cover, the mating cap and the outer edges forming a card-like profile when the protective cover is loaded into the communication system.

9. A protective cover for an electrical connector comprising:

a mating cap having a cap body, the cap body including a connector cavity that opens in a loading direction, the connector cavity configured to receive an electrical connector of a communication system when the mating cap is moved in a loading direction onto the electrical connector, the cap body configured to surround a mating interface of the electrical connector, wherein the cap body has a back wall that extends lengthwise along a lateral axis, the lateral axis being orthogonal to the loading direction;

a system grip that is coupled to the mating cap, the system grip including a securing wall that defines a receiving cavity, the receiving cavity opening in the loading direction and configured to receive an alignment post of the communication system, the securing wall configured to grip the alignment post when received in the receiving cavity; and an operator-engaging tab that is coupled to the back wall and extends away from the back wall in a rearward direction that is generally opposite the loading direction.

10. The protective cover of claim 9, wherein the cap body extends lengthwise along, the lateral axis between opposite first and second cap ends, wherein the system grip is a first system grip and the protective cover includes a second system grip, the first and second system grips extending laterally away from the first and second cap ends, respectively.

11. A protective cover for an electrical connector comprising:

a mating cap having a cap body, the cap body including a connector cavity that opens in a loading direction, the connector cavity configured to receive an electrical connector of a communication system when the mating cap is moved in a loading direction onto the electrical connector, the cap body configured to surround a mating interface of the electrical connector; and a system grip that is coupled to the mating cap, the system grip including a securing wall that defines a receiving cavity, the receiving cavity opening in the loading direction and configured to receive an alignment post of the communication system, the securing wall configured to grip the alignment post when received in the receiving cavity;

wherein the cap body extends lengthwise along a lateral axis between opposite first and second cap ends, the lateral axis being orthogonal to the loading direction, the system grip extending laterally away from one of the first or second cap ends.

12. The protective cover of claim 11, further comprising a movable latch coupled to the mating cap and extending in a rearward direction that is generally opposite the loading direction, the movable latch having a side surface and a latch projection that extends laterally from the side surface, the movable latch configured to flex relative to the mating cap to move the latch projection, wherein the latch projection is configured to engage the communication system to block the protective cover from being inadvertently removed from the electrical connector.

13. The protective cover of claim 11, wherein the receiving cavity is an open-sided cavity that permits the securing wall to stretch or expand for receiving the alignment post of the communication system.

14. The protective cover of claim 11, wherein the system grip includes a leading end that clears the mating cap such that the leading end is located in front of the mating cap during the loading operation.

15. A communication system comprising:

a circuit board having a board side;

a board connector mounted to the board side, the board connector having a mating interface that includes electrical contacts;

a guide element mounted to the board side, the guide element projecting from the board side and including a guide channel that extends parallel to a mating axis; and a protective cover configured to be coupled to the board connector to protect the mating interface from contaminants, the protective cover including a mating cap having a cap body, the cap body including a connector cavity that opens in a loading direction that extends along the mating axis, the connector cavity configured to receive the board connector when the mating cap is moved in the loading direction, wherein the protective cover is sized and shaped to slide within the guide channel during the loading operation.

16. The communication system of claim 15, wherein the cap body extends lengthwise along a lateral axis between opposite cap ends, the lateral axis extending orthogonal to the loading direction.

17. The communication system of claim 15, wherein the protective cover includes a system grip that is coupled to the mating cap, the system grip including a securing wall that defines a receiving cavity, the receiving cavity opening in the loading direction and configured to receive an alignment post of the communication system, the securing wall configured to grip the alignment post when received in the receiving cavity.

18. The communication system of claim 15, wherein the protective cover includes a movable latch that is coupled to the mating cap and extends in a rearward direction that is generally opposite the loading direction, the movable latch having a side surface and a latch projection that extends laterally from the side surface, the movable latch configured to flex relative to the mating cap to move the latch projection, wherein the latch projection is configured to engage the guide element to prevent the protective cover from being inadvertently withdrawn from the board connector.

19. The communication system of claim 18, wherein the guide element includes a channel recess, the movable latch including a latch segment that is positioned within the guide channel when the protective cover is loaded into the guide element, the latch projection extending into the channel recess, the latch projection having a blocking surface that faces in a rearward direction that is generally opposite the loading direction, the blocking surface engaging the guide element if the protective cover is moved in the rearward direction.

20. The communication system of claim 18, wherein the protective cover includes a system grip that is coupled to the mating cap, the system grip including a securing wall that defines a receiving cavity, the receiving cavity opening in the loading direction and configured to receive an alignment post of the communication system, the securing wall configured to grip the alignment post when received in the receiving cavity.

* * * * *